United States Patent [19]

Monguzzi et al.

[11] 4,079,574

[45] Mar. 21, 1978

[54] MACHINE FOR ROLLING BAGS OF PLASTICS

[75] Inventors: Vittoria Monguzzi; Napoleone Trezzi, both of Milan, Italy

[73] Assignee: Mobert Di Trezzi & Monguzzi S.D.F., Castellanza (Varese), Italy

[21] Appl. No.: 728,842

[22] Filed: Oct. 1, 1976

[51] Int. Cl.[2] ..... B65B 63/04

[52] U.S. Cl. ..... 53/119; 242/68.4

[58] Field of Search ..... 53/118, 119; 242/68.4, 242/78.3

[56] References Cited

U.S. PATENT DOCUMENTS

| | | | |
|---|---|---|---|
| 2,813,386 | 11/1957 | Kerr | 53/119 |
| 3,097,806 | 7/1963 | Darman | 242/68.4 |

*Primary Examiner*—Travis S. McGehee

*Attorney, Agent, or Firm*—Fleit & Jacobson

[57] ABSTRACT

A machine for winding up rolls of piles of a sheet material or of bags made of plastics, comprising at least a plane on which piles of sheets are successively collected, at least a frame supporting a revolving body on which a pliers unit is mounted adapted to grip each sheet pile and to cause its rotation under the control of a motor so as to form a sheet roll, said frame being slidably mounted on a transverse guiding means and being actuated by a cylinder-piston unit designed to adjust the position of the frame carrying the pliers with regard of the sheet pile; a device being further provided for causing the controlled starting and stopping of said revolving body in a preestablished position, said device comprising a lever pivotally mounted about a pin and actuated by a cylinder-piston unit so as to let the free end of said lever to be engaged into a notch provided on the peripheral surface of the revolving body.

10 Claims, 6 Drawing Figures

FIG. 5
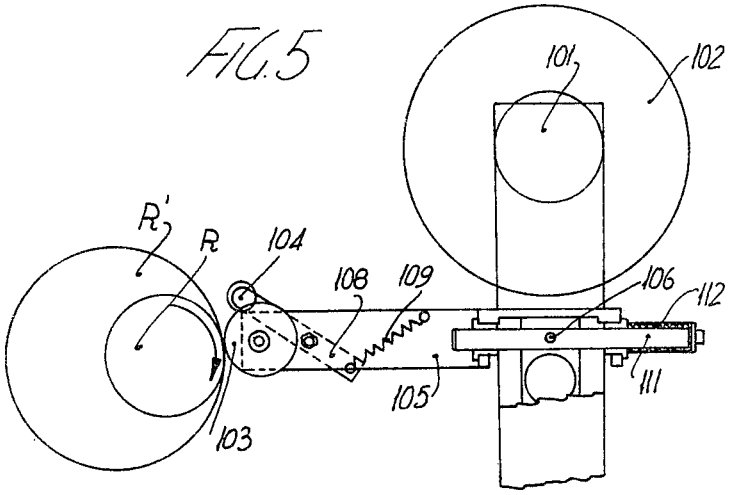
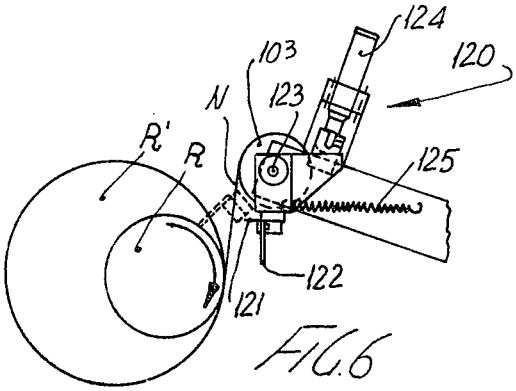
FIG. 6

MACHINE FOR ROLLING BAGS OF PLASTICS

The present invention relates to a machine which is fed by sheet material or with piled up material and which rolls this latter and preferably fix the so obtained rolls by means of an adhesive tape.

This machine has been studied in particular to be used in manufacture lines for bags made of plastics, but it will be apparent that it can be used for other intended purposes. Hitherto, the bags of plastics, which are welded and cut according to known techniques, are mechanically taken and piled up, but, after said bags come out of said piling machine, the piles of bags must be gripped by hand by an attendant and are folded or rolled or tied. However, this operation is rather fatiguing, especially when said bags are of the type which is used for collecting garbage, since in this case they are made of recovery plastic material which is of a particularly slippery character and also on account of the fact that each bag pile is constituted of several bags, commonly from 20 to 50 pieces, said bag pile being produced several times per minute, i.e. about thousand times per day.

Thus the necessity was keenly felt to provide a mechanical means, enabling to perform correctly and again and again the operation of gripping, winding and binding the bags.

The machine of this invention is characterized by the fact that it comprises at least a frame, generally of a box-like type, supporting a motor and housing a rotating body which comprises a first jaw integral with a pliers member which rotates together with said rotating body, said pliers member extending with its jaws parallel to the sheets to be gripped and then rolled up, these jaws passing through an opening arranged in said frame, said rotating body comprising the second jaw of said pliers member, parallel to the first one and which can be displaced and independently by means of a cylinder-piston unit.

In particular, according to this invention, a machine has been studied for winding up a sheet material, in particular bags, made of plastics in piled condition, and which is constituted of slippery material and which has remarkable size, said machine being characterized by the fact that it comprises two rotating or revolving units mounted on a supporting framing, facing each other, said units being mounted on carriages slidable on parallel rails and being able to grip the opposite edges of the sheets, to roll these latter, forming a roll which is conveyed into the machine provided to close each roll by means of an adhesive tape; each carriage carries a transverse sliding guideways enabling to adjust the distance between the two gripping units; each of said gripping units comprising a frame of a boxlike type, into which rotates a rotary body comprising a pliers member made integral with said body and a second movable pliers member actuated by a cylinder piston unit carried by the revolving body, said stationary and said movable pliers members of each revolving body facing each other respectively and being aligned so as to be able to grip the opposite side edges of the sheets to be wound up.

On said machine is mounted a so called "taping" unit, i.e. a device provided to close and fix the so obtained roll by means of an adhesive tape.

The aforedescribed machine is capable of performing by itself, and requiring only a very limited attending, all the operations to collect a predetermined pile of sheets, to roll them into a roll and to fix said roll by means of an adhesive tape. The machine can be fed with sheets and bags of plastics of different size, duly adjusting the mutual positions of the boxlike frames at the limit points of the stroke, or also, in the case of smaller bags, using a sole box-like frame or both the frames rotating in unison for two sets of bags.

A not limitating example of the machine will be described hereinafter, reference being made to the accompanying drawings, in which:

FIG. 5 shows the unit designed to apply the tapes, in an enlarged scale and in a side view; and FIG. 6 shows a detail of FIG. 5 in another position of said unit.

Figure 1:
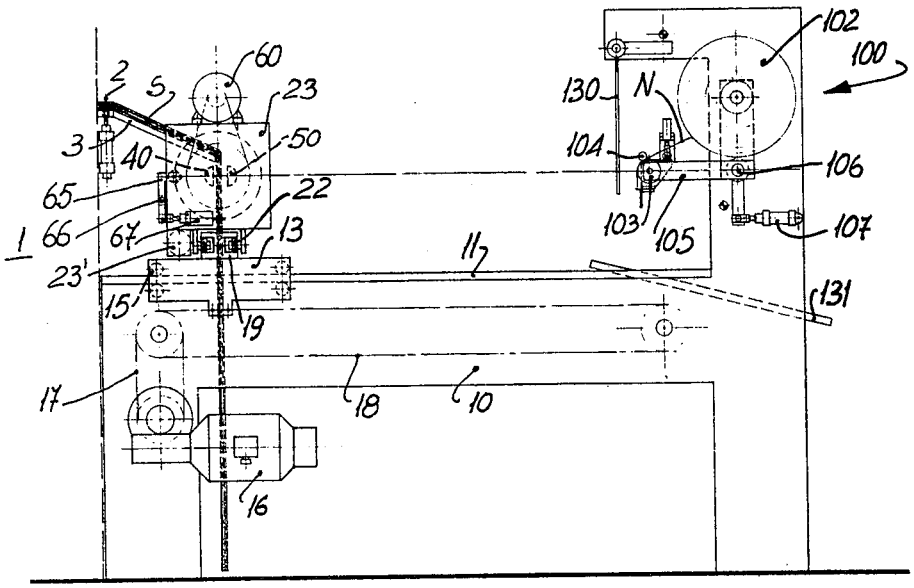
FIG. 1 is a side view of the machine including two facing rotating units designed to form the roll and wherein the carriages are shown in their starting position.

As can be seen from the drawings, the machine in the shown embodiment is fed by the unit 1 (which has been represented diagrammatically on the left edge of the FIG. 1 by broken lines) producing industrial bags of plastics, which are generally marked S in said Figures, and which are conveyed into the machine already piled and retained by a plurality of pins 2, for instance. The bags S are partly placed on a sloping table 3, and partly are depending from the said table 3 in a vertical position. However, it is to be noted that this machine could be used, as whichever other feed position of the columns or stacks of piled up bags is provided, on the condition that said piles present a free surface sufficient for the gripping of said pliers members.

The machine according to this embodiment comprises two parallel rails 11 and 12 mounted on a stationary framing 10. On each rail 11 and 12 can slide a carriage 13 and 14 respectively, which, for instance, has a sleeve-like shape and which is provided with rolling bearings 15. Each carriage is driven by a motor, as the motor 16 for the carriage 13, through the transmission 17, 18, which in this case is constituted of a chain, but which can be also of any other known type.

Figure 2:
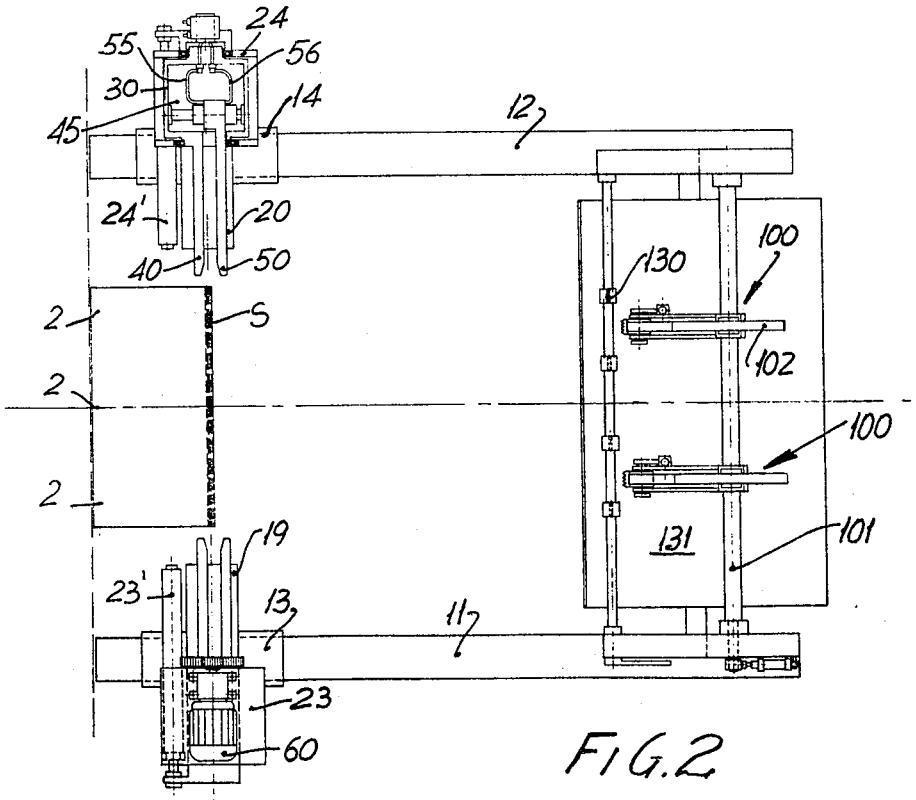
FIG. 2 is a top view of the same machine, in which several parts have been cut away in order to better show the two carriages and the two rails.
Figure 4:
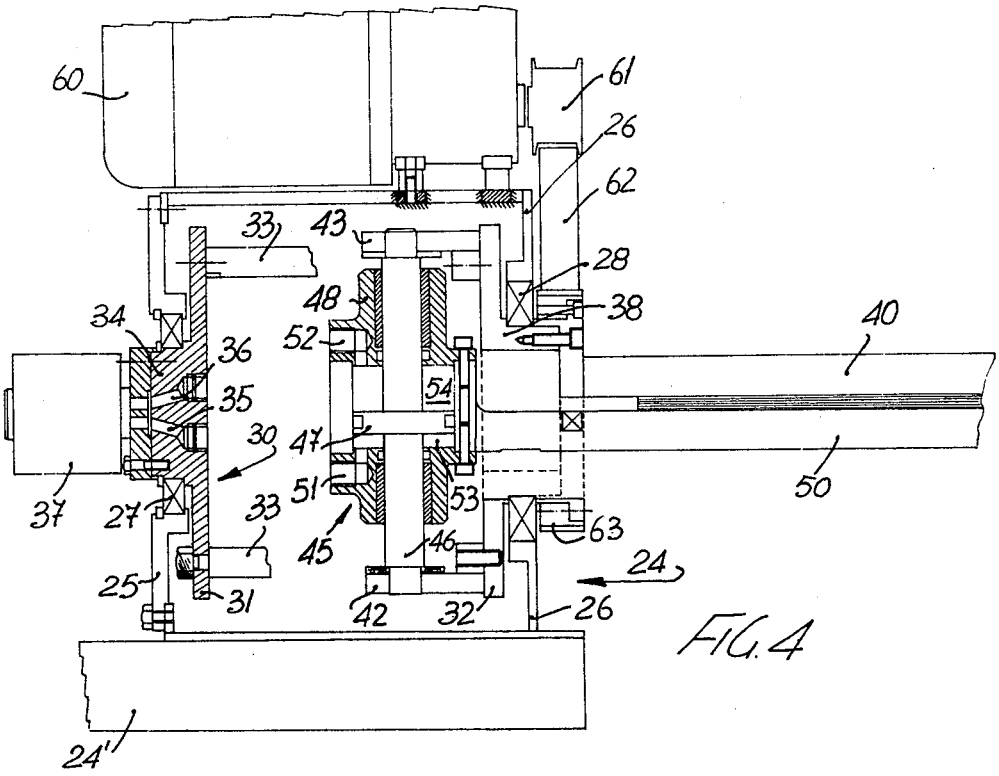
FIG. 4 is a vertical sectional view taken through the boxlike frame and the rolling rotating body, in enlarged scale, with regard of that of FIGS. 1, 2 and 3.

A guide way 19 is fixed on the carriage 13 and a guide way 20 is fixed on the carriage 14 respectively, each guide way extending in a direction set at right angles to the direction of the rails 11 and 12. On each guide way 19, 20 can slide a frame 23 and 24 respectively by means of rollers 22; said frames can have, but not necessarily, a box-like structure. The box-like frames 23 and 24 are identical to each other and are symmetrically arranged, but, their details, those of the frame 24 for instance, as well as their inner organs can be better seen from FIGS. 2 and 4; the movement of said frames 23 and 24 is controlled in this embodiment, by a cylinder-piston unit 23', 24' respectively.

The box-like frame 24 (FIG. 4) has two opposite vertical walls 25, 26 provided with openings, where bearings 27 and 28 respectively are mounted. Into the inner room defined in the inside of the box-like frame 24 on the bearings is mounted a revolving body 30 substantially constituted of a rear plate 31 and a front plate 32 connected to each other by small bars 33. The rear plate 31 comprises a projecting portion 34 resting on the bearing 27 and through which pass the pipes 35, 36 which through a revolving joint 37 of a conventional type can be put in communication with a pressurized fluid source and respectively with an exhaust pipe. The front plate 32 includes a projecting portion 38 adapted to be received into the bearing 28, said projecting portion 38 being made integral with an elongated member 40 constituting one of the jaws of a pliers member between which will be held the pile or column of sheets and which will be hereinafter named "fixed jaw". The second plate 32 carries also, by means of two arms 42, 43 facing the inside of the revolving body, a cylinder-piston unit 45, in which, in the shown embodiment, the piston rod 46, which is securely connected to the ends of the arms 42, 43, carries in an intermediate position a piston 47, along which the cylinder can reciprocate.

The movable cylinder 48 is made integral with a second elongated member 50 of a form similar to that which forms the first jaw 40 of the pliers member, said second jaw 50 will be thereinafter named "second movable jaw". This second jaw 50 extends beyond the opening arranged into the wall 26 of the boxlike frame and is positioned parallel to the fixed jaw 40. In the cylinder 48 holes 51 and 52 are arranged each communicating with one of the chambers 53, 54 defined by the piston 47. The hole 52 is put in communication with the channel 36 and the hole 51 with the channel 35 by means of flexible pipes 55, 56 which can be seen only in FIG. 2.

The rotary movement of the revolving body 30 is controlled by the motor 60, mounted on the boxlike frame 24. In the shown embodiment (FIG. 4) on the driving shaft of the motor 60 is keyed a pinion 61, which through a transmission, a belt transmission 62, for instance, drives a wheel 63 made integral with the revolving body 30.

Preferably, will be provided a means for locking the revolving body 30 in such a position which is particularly suited for the gripping of the pile of bags. This locking means, which can be seen in FIG. 1, consists in a lever 65 pivotally mounted on the pin 66 and actuated at one of its ends by the cylinder piston unit 67 so as to be able to engage with its other end a notch arranged into the peripheral surface of the rotating body 30.

The framing 10 at its end, more distant from the feeding line of the bag piles, comprises one or more units 100 for the taping or fixing of the bag rolls by means of an adhesive tape. In the case, when more than one unit are provided, they are arranged in a side by side relationship in order to be able to fix the bag roll in more than one point contemporaneously.

Each unit 100 comprises, on a spool 101, a roll 102 of adhesive tape, from which the tape N unwinds. The end portion of the tape which has been unwound passes upon an application wheel 103 on which said portion is retained by a stop wheel 104, both said wheels being supported by the end of a level member 105 piovted at 106 and actuated at the other end by a cylinder-piston unit 107. The wheel 104 is pressed against the wheel 103 (FIG. 5) by a small lever 108 pivoted on the lever 105 and held in position by a spring 109. Preferably, but not necessarily, the portion of the lever member 105, supporting the wheel 103 is mounted, as shown in FIG. 5, i.e. it is slideably supported on a piston rod 111 under the effect of a spring 112, in such a manner that it will be pressed against the roll of bags to be fixed. At R and R′ in FIGS. 5 and 6 are indicated the positions taken by two rolls of bags of a different diameter in the front of the taping unit.

By the lever member 105 is also supported a cutting device 120 (FIG. 6) comprising a blade 121 and depending tongue 122, carried by a means pivotally mounted at 123 and controlled by a cylinder-piston unit 124 which may be of a double-acting, or of a simple acting type, as shown in FIG. 6; in this case the return stroke is controlled by a spring 125.

The machine of this invention can further comprise, but not necessarily, depending wings or tabs 130 (FIGS. 1 and 3) mounted slightly upstream of the wheel 103 of the taping (unit or units) and positioned in staggered relationship with regard of these latter. Said tabs are made of flexible material or they may be mounted so as to be able to perform rocking movements, thus helping to maintain the rolls well rolled up.

Underneath the taping unit or units 100 a sloping plane 131 is provided, so as to promote the beginning of rolls to be rolled up and which is fixed to a collecting means; or other collecting means can be provided directly just below said taping units.

The operation of the machine takes place as follows: At the beginning, when a pile of bags S is present in the position shown in FIG. 1, the box-like frames 23, 24 are in the position corresponding to the maximum spacing from each other, which has been predetermined on the respective guideways (FIG. 2), while the pliers members 40, 50 of each revolving body are positioned in spaced away relationship from each other and each revolving body is in the angular position defined by the locking means 65. Then the cylinder-piston units 23′ and 24′ become operative, causing the frames 23 and 24 to move one towards the other up to attain a predetermined position according to the bag size. At this moment each movable jaw 50 tends to close against the associated fixed jaw 40 under the effect of the respective cylinder-piston unit 45.

Then the locking device 65 is released and the motor 60 begins to cause the rotation of the revolving body 30 and therefore of the pliers member 40, 50, which is now already closed, the jaws grip the bag pile winding it into a roll. While this takes place, a translator is concurrently imparted along the rails 11, 12 so as to have a sufficient space to receive a new bag pile which in turn begins to wind up. The translation along the rails 11 and 12 can be slow or speedy, continuous or discontinuous, according to the travel which has to be covered, to the winding turns which are desired, etc. As the carriages come into contact with the wheels 103 of the taping units, the translation movement along the rails 11, 12 is stopped, while the revolving bodies 30 continue their rotation as well as that of the bag rolls. This rotation takes place in the direction of the arrows in FIGS. 5 and 6 and that cause the dragging of the tape N which has its adhesive surface facing the bag roll.

The amount of the applied tape will be easily controlled, by controlling the movement at which the rotation of the pliers, supporting the bag rolls, is stopped. In order to cut the tape N, the wheel 103 (FIG. 6) is raised by means of the cylinder-piston unit 107 and then the cylinder-piston unit 124 becomes operative so as to move the blade 121 together with the tab 122 from the position shown in full lines in FIG. 6 up to the position shown in broken lines. The blade 121 thus cuts the tape N, while the tab 122 accompanies the last cutted tape portion to stick against the roll.

At this moment the cylinder-piston units 45 release the jaws 40 and 50 of the pliers and the cylinder piston units 23' and 24' carry back the box-like frames, letting the bag roll to freely fall down on the sloping plane 131 or into a reservoir placed below.

Figure 3:
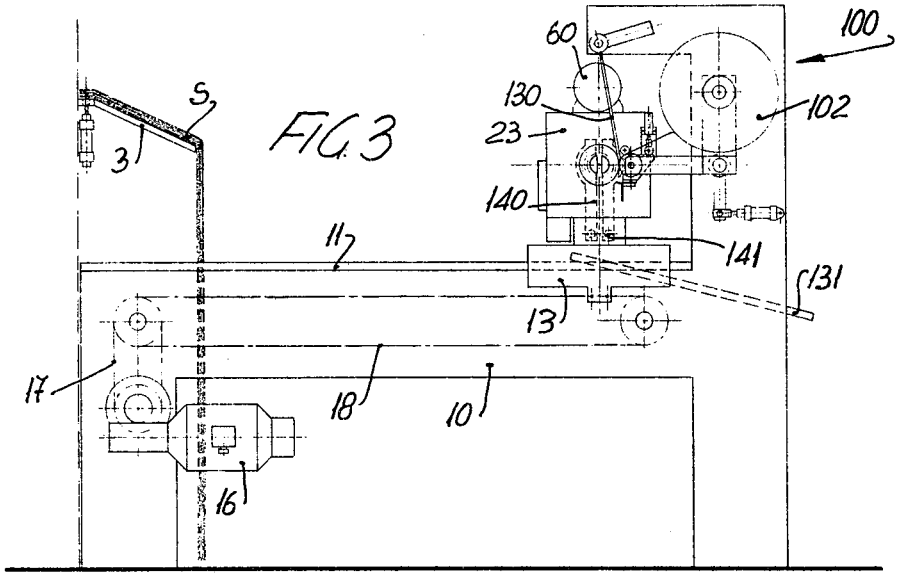
FIG. 3 is a view similar to that of FIG. 1, but when the carriages are positioned near the unit which is designed to tie the rolls by means of an adhesive tape.

In order to facilitate the disengagement of the bags rolls from the pliers, in the event that the material is of such a type which tends to adhere, rocking arms 140 can be provided, shown by broken lines in FIG. 3, which are pivotally mounted at 141 on each guideway 19, 20 (FIG. 2) and which are forced by a spring to attain a position near the pliers 40 and 50 and into contact with these latter. As said pliers move back, the arm 140 fixed to the carriage, push the roll out of said pliers.

Of course, any person skilled in the art can apply, to what has been already described, all the artifices of his skill; as, for instance, the provision of limit switches as well as controls for coordinating the movements, signalers to signal the tape end on the wheel 103 or a lacking of bags, etc. but it has to be understood that all these modifications and variants, which any common person skilled in the art can think, do not depart from the protection field of this invention.

More, in particular, it has to be noted that the winding units can be used also as single units in the case of smaller bags or they can be used independently from the taping unit which has been described and in this case the translation movement along the rails 11 and 12 can be omitted.

What is claimed is:

1. A machine for winding up rolls of piled sheet material, particularly of plastics bags, comprising: a table for at least partly supporting said piled sheet material; winding means including: a frame, a rotary body in said frame, pliers means rotatable with the rotary body for gripping and releasing piled sheet material and having a projecting first jaw member integral with said rotary body and a projecting second jaw member parallel with said first jaw member and shiftable towards and away from said first jaw member, guiding means for supporting said frame for forward and return strokes transversely of said piled sheet material, first motor means for controlling said shifting movement of said second jaw member, second motor means for controlling said forward and return strokes of said frame, and locking means for selectively locking said rotary body in a predetermined angular position.

2. A machine according to claim 1, wherein said frame has a box-like shape and arm means is mounted on said guiding means near the box-like frame in its extreme forward stroke position, said arm means being spring biased to embrace a portion of the said jaw members to disengage a roll of piled sheets from the pliers means during the return stroke of said frame.

3. A machine for winding up rolls of piled sheet material, particularly plastics bags, comprising: a table for supporting piled sheet material; two winding units facing each other, each one including: a frame, a rotary body in said frame, pliers means rotatable with the rotary body for gripping and releasing piled sheet material and having a projecting first jaw member integral with said rotary body and a projecting second jaw member parallel with said first jaw member and shiftable towards and away from said first jaw member, guiding means for supporting said frame forward and return strokes transversely of said piled sheet material, first motor means for controlling said shifting movement of said second jaw member, second motor means for controlling said forward and return strokes of said frame, and locking means for selectively locking said rotary body in a predetermined angular position; two parallel rails extending from positions spaced from both sides of said piled sheet material to discharge positions; movable carriage means supported on each of said two parallel rails, said two winding units being mounted on said carriage means; and motor means for moving said movable carriage means in unison along said rails.

4. A machine according to claim 3, wherein said frame has a box-like shape and arm means are mounted on each said transverse guiding means near each box-like frame in its extreme forward stroke position, said arm means being spring biased to embrace a portion of the said jaw members to disengage a roll of piled sheets from the respective pliers means during the return stroke of said frame.

5. A machine according to claim 3, further comprising means for coordinating the movement of the two rotary bodies with the movement of said frames.

6. A machine for winding up rolls of piled sheet material, particularly plastics bags, comprising: a table for supporting piled sheet material; two winding units facing each other, each one including a frame, a rotary body in said frame, pliers means rotatable with the rotary body for gripping and releasing piled sheet material and having a projecting first jaw member integral with said rotary body and a projecting second jaw member parallel with said first jaw member and shiftable towards and away from said first jaw member, guiding means for supporting said frame for forward and return strokes transversely of said piled sheet material, first motor means for controlling said shifting movement of said second jaw member, second motor means for controlling said forward and return strokes of said frame, and locking means for selectively locking said rotary body in a predetermined angular position; two parallel rails extending from positions spaced from both sides of said piled sheet material to discharge positions; movable carriage means supported on each of said two parallel rails, said two winding units being mounted on said carriage means; motor means for moving said movable carriage means in unison along said rails; and a taping means for holding adhesive tape for tying a roll of piled sheet material.

7. A machine according to claim 6, wherein said taping means comprises: a cylinder adapted to carry a roll of adhesive tape; a first lever means movable between a position in which tape is to be applied to a position in which tape is to be cut; tongue means carried by one end of said first lever means adapted to press an end portion of adhesive tape against a roll of piled sheet material and a cutting device carried by said one end of said first lever means for cutting said end portion of tape.

8. A machine according to claim 6, wherein rotation of said rotary body and associated roll of sheet material causes concurrently dragging of tape from said taping means, the tape being automatically applied about the sheet material roll.

9. A machine according to claim 6, further comprising flexible and rocking tabs mounted slightly upstream of the taping means and staggered with regard to said taping means, said tabs extending outwardly and being adapted to come into contact with a roll of sheet material to maintain the rolled disposition of said sheets.

10. A machine according to claim 7, wherein said cutting device for adhesive tape comprises a blade, said tongue means comprises a flexible tongue, and said taping means includes a second lever supported by said first lever means, said second lever being actuatable to move the blade to cut tape and to move the flexible tongue to apply the portion cut away from the roll of adhesive tape to the roll of sheet material.

* * * * *